US007412750B2

(12) United States Patent
Oh

(10) Patent No.: US 7,412,750 B2
(45) Date of Patent: Aug. 19, 2008

(54) FLOORCLOTH ATTACHED SUCTION BRUSH FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/411,035

(22) Filed: Apr. 26, 2006

(65) Prior Publication Data

US 2007/0074370 A1 Apr. 5, 2007

(30) Foreign Application Priority Data

Sep. 30, 2005 (KR) ..... 10-2005-0091920

(51) Int. Cl.
*A47L 5/00* (2006.01)

(52) U.S. Cl. ..... 15/375; 15/376; 15/380; 15/384; 15/385; 15/389; 15/387

(58) Field of Classification Search ..... None
See application file for complete search history.

(56) References Cited

U.S. PATENT DOCUMENTS 2,904,871 A 9/1959 Brennan

FOREIGN PATENT DOCUMENTS

DE 1 148 045 5/1963
DE 103 03 730 12/2003
JP 2002-253458 9/2002
KR 1994-0000570 2/1994
KR 10-2003-0071337 A 9/2003
KR 2003-0093625 12/2003
KR 20-0370525 12/2004

OTHER PUBLICATIONS

Patent Office of the Russian Federation, Office Action issued Jul. 5, 2007, with respect to Russian Patent Application 2006118004. Russian with English translation.

*Primary Examiner*—David A Redding
(74) *Attorney, Agent, or Firm*—Blank Rome LLP

(57) ABSTRACT

A suction brush that includes a body in communication with a dust collection apparatus of a vacuum cleaner and having a main suction port formed through a bottom of the body, and a cover for covering the top of the body, the cover having auxiliary suction ports. A pair of floorcloth support plates are rotatably mounted on the bottom of the body, with floorcloths that are detachably attached to the bottom surfaces of the floorcloth support plates, respectively. A floorcloth rotation unit is mounted in the body so as to rotate the pair of floorcloth support plates. The suction brush also includes a first air suction flow path for guiding air, which is introduced through the main suction port, to the rear side of the body, and a second air suction flow path for guiding air, which is introduced through the auxiliary suction ports to the rear side of the body.

4 Claims, 5 Drawing Sheets

FLOORCLOTH ATTACHED SUCTION BRUSH FOR VACUUM CLEANER

REFERENCE TO RELATED APPLICATION

This application claims the benefit of Korean Patent Application No. 2005-91920, field on Sep. 30, 2005, with the Korean Intellectual Property Office, the disclosure of which is incorporated herein by reference.

FIELD OF THE INVENTION

The present invention relates to a floorcloth attached suction cleaner to be used with a vacuum cleaner.

BACKGROUND OF THE INVENTION

In general, a vacuum cleaner is an appliance for cleaning by suctioning dust or dirt from a surface using suction force generated by a vacuum motor while moving a suction brush along the surface. Such a vacuum cleaner is somewhat efficient in removing dust scattered on a surfaced to be cleaned. However, such a vacuum cleaner has a disadvantage in that it is inefficient in removing stains or foreign matter matted to the surface to be cleaned. That inconveniences the user who must first remove dust accumulated on the floor using a cleaner, and then directly wipe the surface using a floorcloth to remove the foreign matter or stain remaining on the surface.

In order to solve this problem, a conventional suction brush of a vacuum cleaner disclosed in Korean Utility Model Registration No. 370525 comprises a floorcloth rotation arrangement for rotating a wet floorcloth within the suction brush, so that the removal of dust and wiping can be concurrently performed. The floorcloth rotation arrangement comprises an impeller which is rotated as ambient air is suctioned, plural spur gears for transferring the rotational movement of the impeller to the opposite lateral sides of the bottom side of the suction brush, and a floorcloth plate member for rotating the wet floorcloth using the rotational force transferred through the plural spur gears.

That conventional suction brush with the floorcloth rotation arrangement has a suction port for suctioning air so as to drive the impeller, in which the suction port is formed through the bottom side of the suction brush which is opposite to the surface to be cleaned, whereby if air is suctioned through the suction port when the impeller is driven, dust scattered on the surface to be cleaned as well as ambient air are introduced into the suction port and transferred to the impeller.

Therefore, dust accumulates between the impeller and its driving shaft for driving the impeller, as well as on the impeller, and thus inhibiting smooth operation of the impeller, thereby limiting the number of revolutions of the wet floorcloth and reducing the wiping effect.

In addition, because the impeller has a cone shape, the height of which increases as it approaches the center of the impeller due to the characteristics of the impeller, and the plural spur gears are used so as to transfer power, it is difficult to configure the suction brush in a compact form.

In addition, because the plural spur gears are employed, it is necessary to provide a bearing for each gear, thereby increasing and the number of components manufacturing costs. Furthermore, the spur gears, generate loud noise when the gears are driven.

Commonly owned Korean Patent Publication No. 2003-93625, discloses a floorcloth attached suction brush for a vacuum cleaner. The suction brush has a floorcloth rotation arrangement for rotating a floorcloth, in which the suction brush comprises a turbine which is driven by the suction force of the suction brush, so that the floorcloth rotates through worm wheels and gears connected to the opposite sides of the turbine, respectively.

However, this suction brush has a problem in that if hair or the like is caught in the turbine shaft or the like, the turbine stops, and thus the rotation of the floorcloth is stopped, whereby the wiping function cannot be used.

SUMMARY OF THE INVENTION

Accordingly, the present invention has been made to solve the above-mentioned problems occurring in the prior art.

There is provided a suction brush for a vacuum cleaner including a body having a main suction port formed through the bottom of the body; a cover for covering the top of the body, the cover being provided with plural auxiliary suction ports; a pair of floorcloth support plates rotatably mounted on the bottom of the body, with floorcloths being detachably attached to the bottom sides of the floorcloth support plates, respectively; a floorcloth rotation unit mounted in the body so as to rotate the pair of floorcloth support plates; a first air suction flow path for guiding air introduced through the main suction port to the rear side of the body; and a second air suction flow path for guiding air introduced through the plural auxiliary suction ports to the rear side of the body.

The floorcloth rotation unit may comprise a driving shaft arranged in such a manner as to be rotatable in relation to the body and the cover, a worm gear being formed around the circumference of the lower part of the driving shaft; a driving fan engaged with the upper part of the driving shaft; a driven shaft arranged perpendicular to the driving shaft and having a worm wheel provided at the longitudinal center of the driven shaft, in which the worm wheel is meshed with the worm gear so that the driven shaft transfers the rotational force of the driving shaft to the body; a pair of driven shafts arranged at the opposite ends of the driven shaft, the lower ends of the driven shafts being individually engaged with the floorcloth support plates; and two pairs of bevel gears arranged between the opposite ends of the driven shaft and the pair of driven shafts, respectively.

A cross-flow turbofan may be applied as the driving fan. In addition, the driving fan has plural vanes which are arranged away from the center of the driving fan as far as possible and along the circumferential direction, whereby the rotational torque for the driving fan can be increased through a flywheel effect when the driving fan rotates and thus the rotational force of the driving fan can be increased.

The two pairs of bevel gears may be spiral bevel gears, which can reduce noise.

The cover may have a fan receiving part with an inner diameter, which is larger than that of the driving fan so as to receive the driving fan, the fan receiving part being projected upward. The plural auxiliary suction ports may be formed along the circumferential wall of the fan receiving part. The plural auxiliary suction ports may be provided with plural guide pieces, each of which is provided within a corresponding auxiliary suction port. The plural guide pieces may be inclined in a same direction so as to guide air, which is introduced into the fan receiving part, in a tangential direction of the driving fan.

DESCRIPTION OF THE DRAWINGS

The above aspects and features of the present invention will be more apparent from the description for certain embodiments of the present invention taken with reference to the accompanying drawings, in which.

DETAILED DESCRIPTION OF THE PREFERRED EMBODIMENTS

Hereinbelow, the preferred embodiments of the present invention are described in detail with reference to accompanying drawings. In the following description, a detailed description of known functions and configurations incorporated herein will be omitted when it may make the subject matter of the present invention rather unclear.

Figure 1:
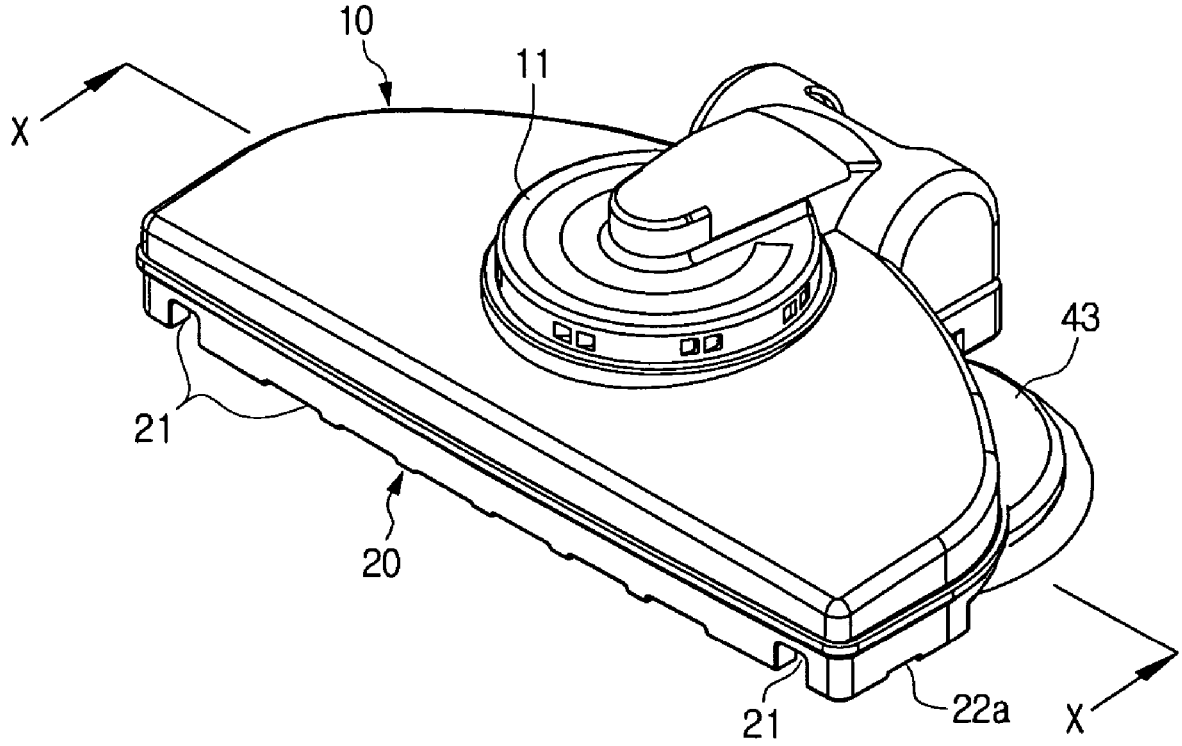
FIG. 1 is a perspective view showing a floorcloth attached suction brush for a vacuum cleaner according to an embodiment of the present invention in an assembled state.
Figure 2:
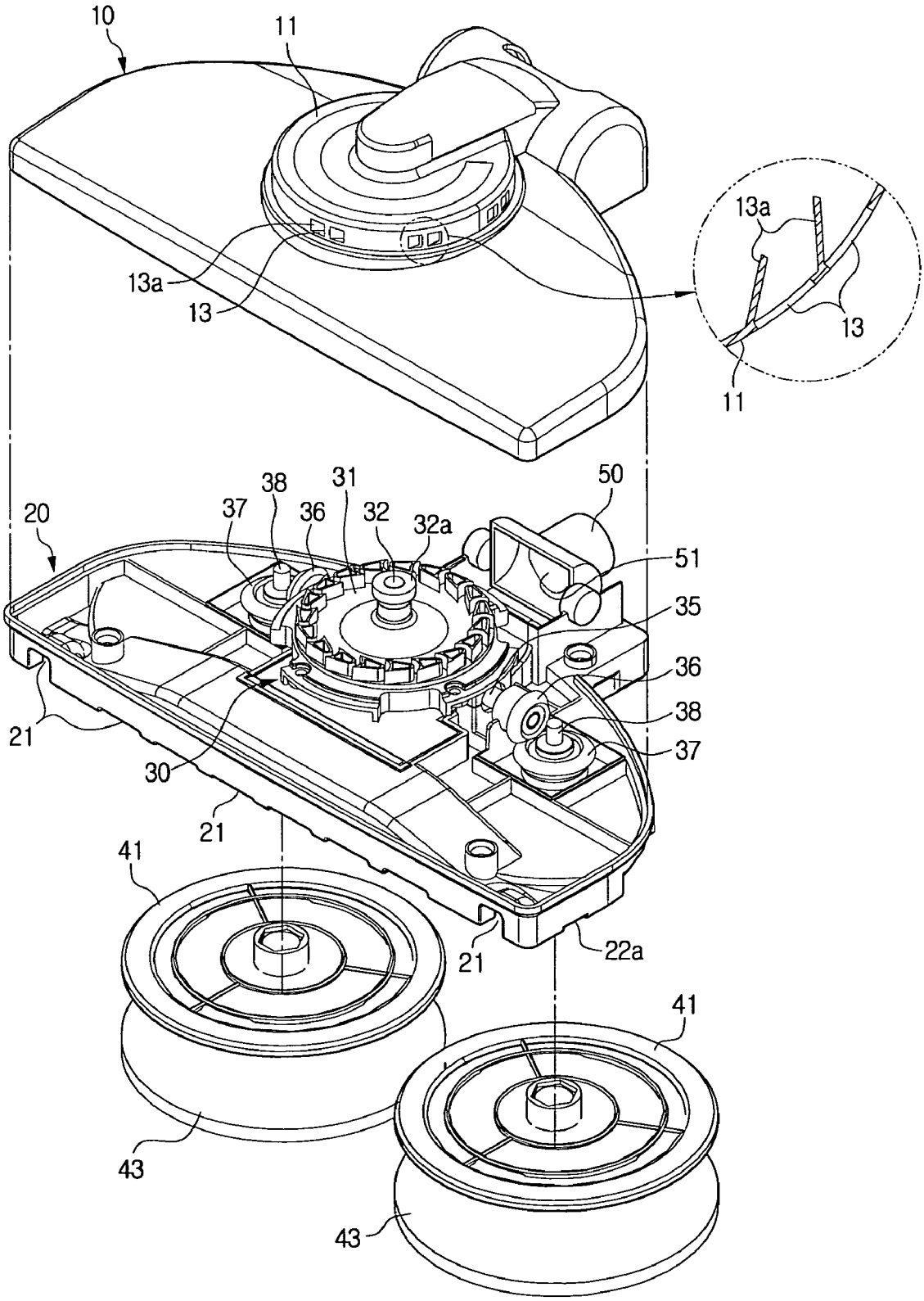
FIG. 2 is an exploded perspective view the floorcloth attached suction brush illustrated in FIG. 1.
Figure 3:
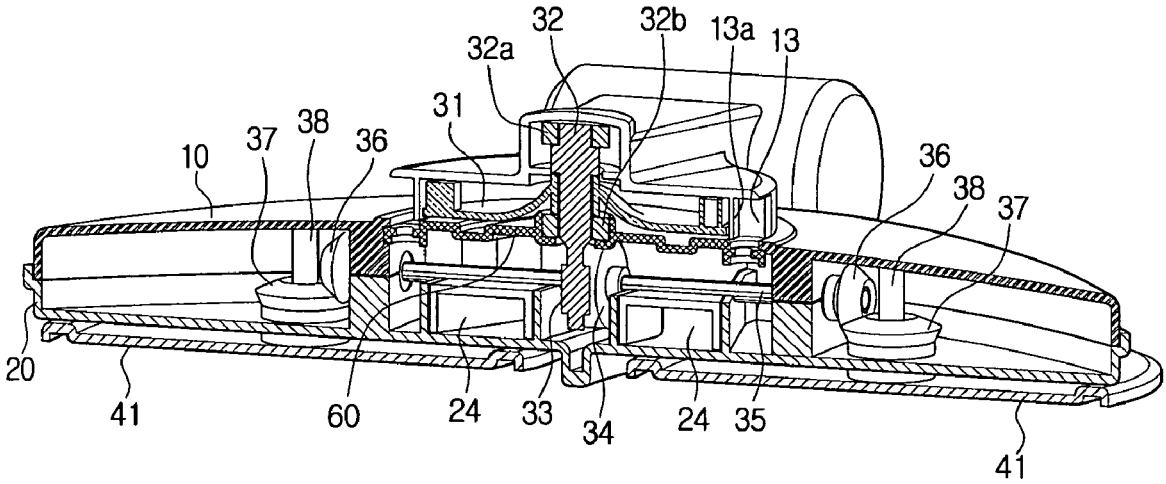
FIG. 3 is a side elevational view of the floorcloth attached suction brush illustrated in FIG. 1 taken along line X-X.
Figure 4:
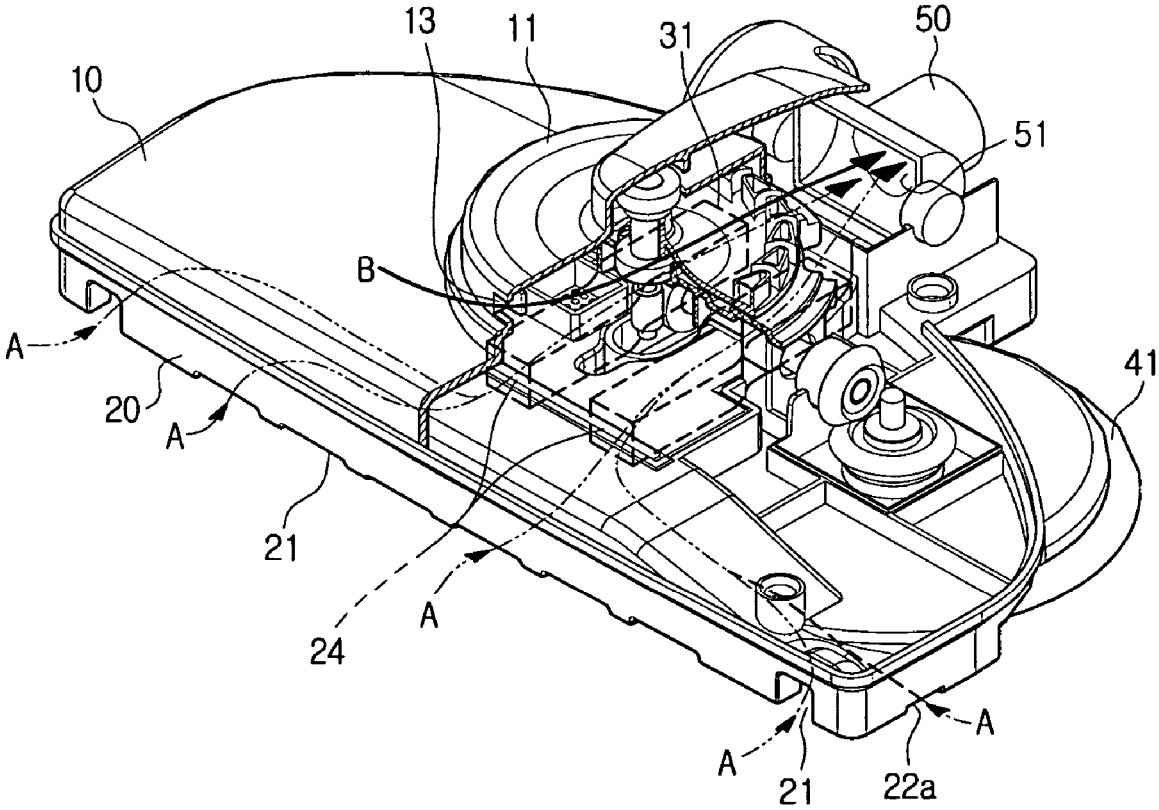
FIG. 4 is a perspective view of the floorcloth attached suction brush illustrated in FIG. 1 showing, partially in cross-section, two-way air flow paths.
Figure 5:
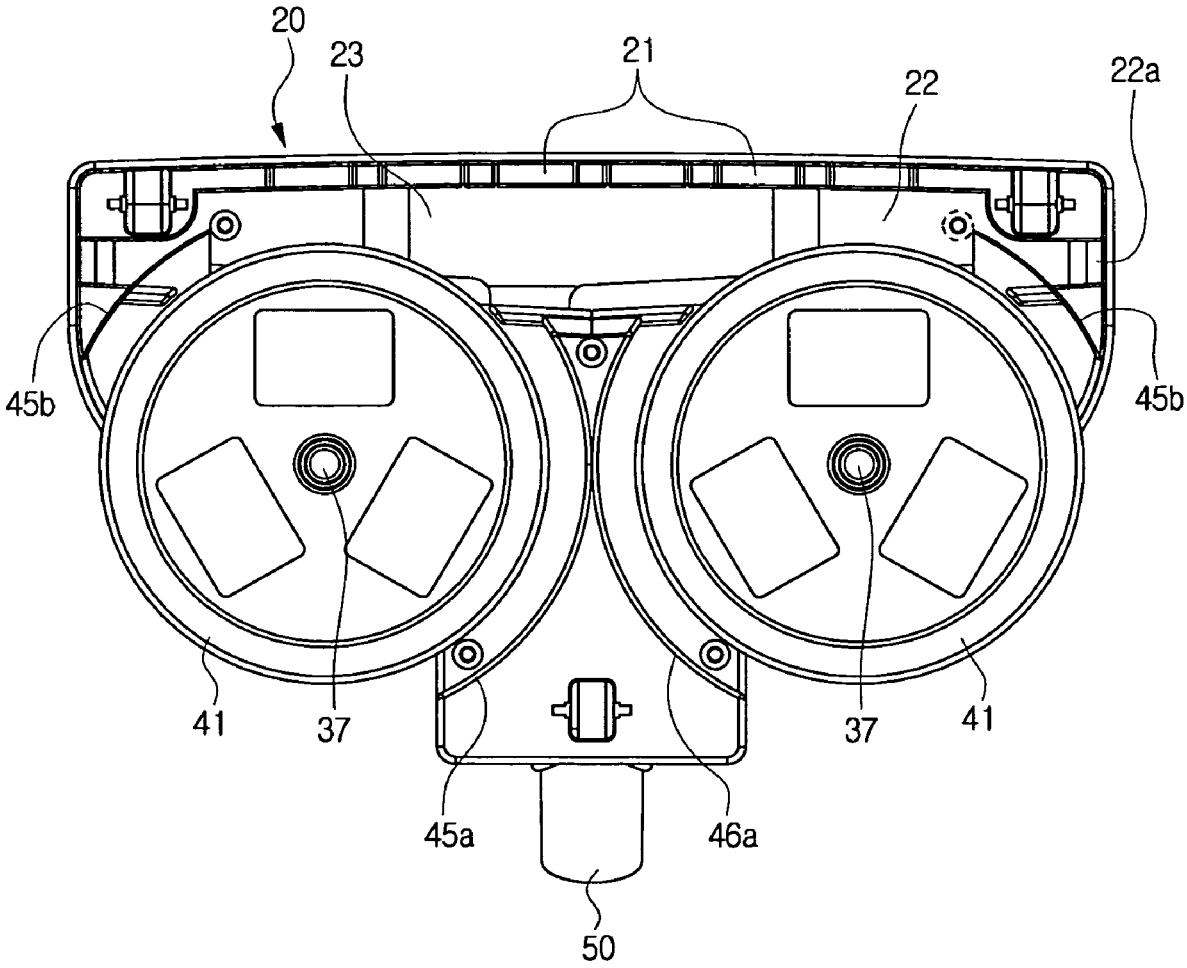
FIG. 5 is a bottom plan view of the floorcloth attached suction brush illustrated in FIG. 1.

FIG. 1 is a perspective view showing a floorcloth attached suction brush of a vacuum cleaner according to an embodiment of the present invention in an assembled state, FIG. 2 is an exploded perspective view the floorcloth attached suction brush of a vacuum cleaner according to the embodiment of the present invention, FIG. 3 is a cross-sectional view taken along line X-X of FIG. 1, FIG. 4 is a perspective view showing, partially in cross-section, a two-way air flow path of the floorcloth attached suction brush of a vacuum cleaner according to the present invention, and FIG. 5 is a bottom view of the floorcloth attached suction brush of a vacuum cleaner according to the embodiment of the present invention.

According to an embodiment of the present invention, the suction brush may comprise a body 20 that communicates with a dust collection apparatus (not shown) directly or through a flexible hose (not shown), and a cover 10 detachably joined to the top of the body 20, as shown in FIG. 1. In addition, the suction brush may further comprises a floorcloth rotation unit 30 installed in the body 20, and a pair of floorcloth support plates 41 each for supporting a floorcloth 43 (see FIG. 2).

The body 20 may include plural dirt suction grooves 21 formed on the front side of the bottom of the body 20 for suctioning scattered dirt on a surface to be cleaned, and a dust guide groove 22 for guiding dirty air, which is introduced from lateral sides of the body 20, to a main suction port 23 (see FIG. 5). The body 20 may further include a pair of dirt suction passages 24 arranged between the main suction port 23 and a communication bore 51 of an intake air connector 50 so as to guide the dirty air passing through the main suction port 23 to the communication bore 51, which joins the rear part of the body 20, as shown in FIG. 3. The dirt suction grooves 21, the dust guide groove 22, the main suction port 23, and the dirt suction passages 24 form a first air flow path A for suctioning the dirty air (see FIG. 4).

In addition, a fan receiving part 11 may be formed in such a manner as to be projected from the top of the center of the cover 10 so as to receive a driving fan 31, and plural auxiliary suction ports 13 may be formed around the circumferential wall of the fan receiving part 11 in a predetermined interval, wherein the inner diameter is somewhat larger than the diameter of the driving fan 31, as shown in FIG. 2.

The plural auxiliary suction ports 13 may be formed with guide pieces 13*a*, each of which is arranged within a corresponding auxiliary suction port 13. The guide pieces 13*a* are inclined in a same direction so as to tangentially guide the air introduced into the fan receiving part 11, thereby facilitating the rotation of the driving fan 31. The auxiliary suction ports 13 and the fan receiving part 11 form a second air flow path B for causing air, which does not contain dirt, to be introduced into the fan receiving part 11 and rotate the driving fan 31 (see FIG. 4).

As shown in FIG. 3, the floorcloth rotation unit 30 for rotating the pair of floorcloth support plates 41 may include a driving shaft 32 vertically and rotatably arranged in relation to the cover 10 and the body 20, and a worm gear 33 formed around the circumference of the lower part of the driving shaft 32. The driving fan 31 may be joined to the upper part of the driving shaft 32, and the driving fan 31 and the driving shaft 32 are rotatably supported by a supporter 60 located below the fan receiving part 11. More specifically, the driving shaft 32 is supported by an upper bearing 32*a* at the internal center of the fan receiving part 11, and the central lower part of the driving fan 31 is supported by a lower bearing 32*b* installed in the supporter 60.

Meanwhile, the driving fan 31 may be formed by a cross-flow turbo fan, wherein plural vanes 31*a* are arranged on the top of the driving fan 31 in such a manner that the plural vanes 31*a* are arranged away from the center of the driving fan 31 as far as possible and in the circumferential direction of the driving fan 31 with a same interval, as shown in FIG. 2. Because the plural vanes 31 a are arranged remote from the center of the driving fan 31 in this manner, it is possible to obtain a flywheel effect when the driving fan 31 rotates, whereby the rotational torque for the driving fan 31 can be increased, and thus the rotational force of the driving fan can be increased.

As a result, the rotational force of the floorcloths 43, so that it is possible to prevent the floorcloths 43 from being stopped even if the user strongly compresses the suction brush against the surface to be cleaned. In addition, it is possible to partially compensate for the weakening of the rotational force of the driving fan 31, which may be caused by a decrease in the suction force if a dust envelope is filled with dust or under other various conditions.

In addition, the driving fan 31 is formed in a generally flat shape, which is different than the conventional impeller formed in a mountain shape, the central part of which is highly protrudent. Therefore, the height of the driving fan 31 can be reduced, making the suction brush more compact.

In addition, as shown in FIG. 3, a first driven shaft 35, which is arranged perpendicular to the driving shaft 32 and rotatably installed in the body 20, has a worm wheel 34 provided at the longitudinal center of the first driven shaft 35 and meshing with the worm gear 33, whereby the first driven shaft 35 serves to transfer the rotational force of the driving shaft 32 to the opposite sides of the body 20.

According to an embodiment of the present invention, it is possible to obtain a high reduction ratio using the worm gear 33 and the worm wheel 34, resulting in the number of final revolutions only using one step gear arrangement, and thus it is possible to reduce the total number of gears and the number of bearings employed for the gears as compared to the prior art. Consequently, it is possible to fabricate the suction brush in a compact form and reduce material costs.

Furthermore, as shown in FIG. 3, a pair of second driven shafts 38 are located adjacent to the opposite ends of the first driven shaft 35, respectively, and engaged with the pair of floor support plates 41, respectively, at the lower ends thereof.

The opposite ends of the first driven shaft 35 are each provided with first bevel gears 36, and the pair of second driven shafts 38 are each provided with second bevel gears 37, which are perpendicularly meshed with the first bevel gears 36, respectively.

The first bevel gears 36 are formed in a diameter which is smaller than that of the second bevel gears 37, so that the rotational velocity of the first driven shaft 35 can be further reduced in addition to the reduction caused by the worm gear, wherein the rotational force is transferred to the second driven shafts 38 through the first and second bevel gears 36 and 37 after the rotational velocity is reduced as described above, whereby the floor support plates 41 with dry or wet floorcloths 43 can be rotated with a proper rotational velocity to provide efficient wiping.

According to an embodiment of the present invention, spiral bevel gears may be used as the first and second bevel gears 36 and 37 so as to reduce noise as well as to efficiently transfer power.

Meanwhile, as shown in FIG. 5, first and second pairs of round guides 45*a* and 45*b*; 46*a* and 46*b* are formed on the bottom side of the body 20, wherein the round guides are symmetrically arranged about the center of the bottom of the body 20, and each of the round guides has a diameter which is somewhat larger than that of the floorcloth support plate 41.

The operation of the suction brush configured according to the above-mentioned embodiment of the present invention is now described with reference FIGS. 3 and 4. Initially, a user positions the suction brush on a surface to be cleaned and then turns on the power source of the vacuum cleaner, so that the vacuum motor (not shown) of the vacuum cleaner is operating. As such, a predetermined level of vacuum pressure is generated between the bottom surface of the suction brush and the surface to be cleaned, and air surrounding the suction brush is suctioned into the dust collection apparatus and the first and second air suction flow paths A and B, which are separated from each other as shown in FIG. 4, and via the communication bore 51 of the intake air connector 50.

Regarding the first air suction flow path A, as shown in FIG. 4, dirt scattered on the surface to be cleaned and dirty air are guided to the center of the dust guide groove 22 through the dirt suction grooves 21 and the opposite ends 22*a* of the opposite ends of the dust guide groove 22, which are formed through the front side and lateral sides of the suction brush, and then suctioned into the main suction port 23. Next, the air containing dirt is guided to the rear side of the body 20 by the dirt suction passages 24 (see FIG. 3) and suctioned into the dust collection apparatus (not shown) via the communication bore 51 of the intake air connector 50.

Now, the description is made in terms of the procedure for air to be introduced into the suction brush through the second air suction flow path B and the operation of the floorcloth rotation unit 30.

Regarding the second air suction flow path B, as shown in FIG. 4, ambient air surrounding the cover 10 is suctioned through the plural auxiliary suction ports 13, wherein the air introduced into the auxiliary suction ports 13 is guided by the guide pieces 13*a*, thereby rapidly flowing into the fan receiving part 11.

The air introduced into the fan receiving part 11 flows in a tangential direction of the driving fan 31 and strikes against the plural vanes 31 a of the driving fan 31 with a high flow rate, thereby rotationally driving the driving fan 31 in the air flowing direction, and at the same time, the driving shaft 32 also rotates in the same direction with the driving fan 31. Because the plural vanes 31*a* are positioned on the driving fan 31, it is possible to obtain a flywheel effect when the driving fan 31 is rotates, thereby increasing the rotational torque for the driving fan 31.

Next, the rotational force is transferred to the worm wheel 34 which is meshed with the worm gear 33, thereby rotating the first driven shaft 35, and thus the rotational force is transferred vertically downward through the first and second bevel gears 36 and 37 which are located at the opposite ends of the first driven shaft 35.

Like this, because the power transfer is implemented using the worm gear, a large reduction ratio can be obtained through only one step gear arrangement, whereby the number of components, i.e., gears and bearings can be reduced. As a result, it is possible to fabricate a suction brush in a compact form. Furthermore, because a pair of first bevel gears 36 and a pair of second bevel gears 37 of spiral type are employed so as to change the power transfer direction, the noise can be reduced and the power transfer can be efficiently performed.

Consequently, as the second driven shafts 38 respectively connected to the second bevel gears 37 are rotated, the floorcloth support plates 41, which are eccentrically connected to the lower ends of the second driven shafts 38, are rotated about the second driven shafts 38.

Next, as the floorcloth support plates 41 respectively engaged with the rotating second driven shafts 38, the floorcloths 43 are rotated, thereby efficiently wiping dirt stuck to the floor, such as a sticky stain of a beverage or the like.

At this time, as the rotational force of the driving fan 31, the rotational torque for which is increased by the above-mentioned flywheel effect, is increased, the floorcloths 43 can be strongly rotated, whereby it is possible to prevent the floorcloths 43 from being stopped by compression even if the user strongly compresses the suction brush against the surface being cleaned. In addition, it is possible to partially compensate for the weakening of the rotational force caused when the suction force is weakened as the dust envelope is filled with dirt or under various conditions, thereby inducing the smooth rotation of the driving fan 31.

Meanwhile, a conventional suction brush suctions air for rotating the impeller from the bottom side of the suction brush. Whereas, the embodiment of the present invention is configured in such a way that the driving fan 31 is rotated by the air introduced through the first and second air suction flow paths A and B, which are separated from each other.

Therefore, the embodiment of the present invention basically prevents dirt on the surface being cleaned from being directly introduced into the driving fan 31, unlike the prior art, whereby dust, hair or the like is prevented from accumulating on the driving fan 31 or the driving shaft 32. As a result, it is possible to prevent stopping of the driving fan 31 or the reduction of the rotational velocity of the driving fan 31, whereby the wiping can be reliably performed.

According to the present invention, because the first air flow path A for suctioning dirt and the second air flow path B for suctioning air for driving the driving fan are separated from each other, and the air flowing into the second air flow path B is introduced through the plural auxiliary suction ports 13 formed on the cover 10, which is remotely positioned with respect to the surface being cleaned, it is possible to prevent dust, hair or the like from being suctioned into the driving fan 31 in advance, so that the rotation of the driving fan 31 is not blocked by the dust, hair or the like.

In addition, because the accumulation of foreign matter on the driving fan 31 can be reduced, it is possible to avoid the trouble of frequently cleaning the driving fan 31 so as to remove the foreign matter and to reduce slight accidents.

Moreover, because the rotational torque for the driving fan 31 can be increased through the flywheel effect, the rotational force of the driving fan 31 can be increased, whereby it is possible to strongly rotate the floorcloths 43 so that the floorcloths 43 are not stopped by compression even if a user strongly compresses the suction brush against a surface to be cleaned during the cleaning. Further, it is possible to partially compensate the weakening of the rotational force caused in a case in which the suction force is weakened as the dust envelope is filled with dirt or under various conditions.

Because the power transfer is implemented using the worm gear 33, a large reduction ratio can be obtained through only one step gear arrangement, whereby the number of components, i.e., gears and bearings can be reduced. As a result, it is possible to fabricate the suction bush in a compact form. Furthermore, because a pair of first bevel gears 36 and a pair of second bevel gears 37 of spiral type are employed so as to change the power transfer direction, the noise can be reduced and the power transfer can be efficiently performed.

Although representative embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A suction brush of a vacuum cleaner comprising:

a body having a main suction port formed through a bottom of the body;

a cover for covering a top of the body, the cover being provided with a plurality of auxiliary suction ports;

a pair of floorcloth support plates rotatably mounted on the bottom of the body;

first and second floorcloths being detachably attached to a bottom surface of the floorcloth support plates, respectively;

a floorcloth rotation unit mounted in the body that rotates the pair of floorcloth support plates;

a first air suction flow path for guiding air introduced through the main suction port to a rear side of the body; and a second air suction flow path for guiding air introduced through the plurality of auxiliary suction ports to the rear side of the body, wherein the floorcloth rotation unit comprises:

a driving shaft arranged to be rotatable in relation to the body and the cover;

a worm gear being formed around the circumference of a lower part of the driving shaft;

a driving fan engaged with an upper part of the driving shaft;

a first driven shaft arranged perpendicular to the driving shaft and having a worm wheel provided at a longitudinal center of the first driven shaft, in which the worm wheel is meshed with the worm gear so that the first driven shaft transfers the rotational force of the driving shaft to opposite lateral sides of the body;

a pair of second driven shafts arranged at opposite ends of first driven shaft, lower ends of the second driven shafts being individually engaged with the floorcloth support plates; and two pairs of bevel gears arranged between the opposite ends of the first driven shaft and the pair of second driven shafts, respectively.

2. A suction brush as claimed in claim 1, wherein the driving fan is a cross-flow turbofan.

3. A suction brush as claimed in claim 1, wherein the driving fan has a plurality of vanes located remote from the center of the driving fan along a circumferential direction.

4. A suction brush as claimed in claim 1, wherein the two pairs of bevel gears are spiral bevel gears.

* * * * *